US006927751B2

(12) United States Patent
Ide et al.

(10) Patent No.: US 6,927,751 B2
(45) Date of Patent: Aug. 9, 2005

(54) PLASMA DISPLAY APPARATUS HAVING A DRIVER PROTECTING PORTION

(75) Inventors: Shigeo Ide, Yamanashi (JP); Takashi Iwami, Yamanshi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 80 days.

(21) Appl. No.: 10/151,898

(22) Filed: May 22, 2002

(65) Prior Publication Data

US 2002/0180668 A1 Dec. 5, 2002

(30) Foreign Application Priority Data

May 31, 2001 (JP) ..... 2001-163835

(51) Int. Cl.[7] ..... G09G 3/28; G09G 5/00

(52) U.S. Cl. ..... 345/67; 345/60; 345/212; 315/169.4

(58) Field of Search ..... 345/55, 60–67, 345/204–214, 690–699, 87–104; 315/169.1, 169.4

(56) References Cited

U.S. PATENT DOCUMENTS

| | | | | | |
|---|---|---|---|---|---|
| 4,855,892 | A | * | 8/1989 | Lower | 363/86 |
| 5,943,030 | A | * | 8/1999 | Minamibayashi | 345/60 |
| 5,973,655 | A | * | 10/1999 | Fujisaki et al. | 345/63 |
| 6,023,258 | A | * | 2/2000 | Kuriyama et al. | 345/60 |
| 6,480,176 | B1 | * | 11/2002 | Lardeau et al. | 345/60 |
| 6,522,314 | B1 | * | 2/2003 | Tomio et al. | 345/68 |
| 2001/0022584 | A1 | * | 9/2001 | Tsugawa | 345/211 |

* cited by examiner

*Primary Examiner*—Dennis-Doon Chow
*Assistant Examiner*—Leland R. Jorgensen
(74) *Attorney, Agent, or Firm*—Sughrue Mion, PLLC

(57) ABSTRACT

A plasma display apparatus which can surely prevent an overcurrent flowing in a driver for driving electrodes of a plasma display panel. A power source is shut off when an internal short-circuit state of a column electrode driver is detected based on a current or an electric potential on a power line in a column electrode driver detected during a light emission sustaining period.

5 Claims, 10 Drawing Sheets

PLASMA DISPLAY APPARATUS HAVING A DRIVER PROTECTING PORTION

BACKGROUND OF THE INVENTION

1. Field of the Invention

The present invention relates to a plasma display apparatus.

2. Description of Related Art

Plasma display panels are nowadays drawing attention as a type of thin-shape flat display device.

FIG. 1 is a diagram schematically showing the construction of a plasma display apparatus having a plasma display panel mounted therein.

In FIG. 1, a PDP 10 as a typical plasma display panel comprises: m column electrodes $Z_1$ to $Z_m$; and n row electrodes $X_1$ to $X_n$ and n row electrodes $Y_1$ to $Y_n$ arranged so as to cross the column electrodes, respectively. The row electrodes $X_1$ to $X_n$ and row electrodes $Y_1$ to $Y_n$ constitute a first display line to an nth display line in the PDP 10 by pairs of row electrodes $X_i$ ($1 \leqq i \leqq n$) and $Y_i$ ($1 \leqq i \leqq n$), respectively. A discharge space filled with a discharge gas is formed between the column electrodes Z and the row electrodes X and Y. A discharge cell which performs a discharge light emission in red color, a discharge cell which performs a discharge light emission in green color, or a discharge cell which performs a discharge light emission in blue color is formed at each of intersecting portions of each row electrode pair and the column electrode that include the discharge space. Since each discharge cell emit light by using a discharge phenomenon, only two states, "light emitting state" associated with the discharge and "light-off state" can be taken by the discharge cell. That is, each discharge cell can express only luminance of two gradations of the lowest luminance and the highest luminance.

The driving apparatus 100, therefore, performs the gradation driving using a subfield method so as to realize a luminance display of a halftone corresponding to a video signal in the PDP 10 having the discharge cells. According to the subfield method, a display period of one field is divided into a plurality of subfields, and a discharge light emitting period corresponding to the subfield is allocated to each subfield. Each discharge cell is allowed to selectively perform the discharge light emission only for the allocated period of time for each subfield in accordance with the input video signal.

FIG. 2 is a diagram showing various driving pulses which are applied by the driving apparatus 100 to the row electrode pair and the column electrode of the PDP 10 in one subfield and their timings of applications in order to execute the gradation driving as mentioned above. A row electrode driver and a column electrode driver (not shown) for generating the various driving pulses are provided for the driving apparatus 100.

In an all-resetting step Rc in FIG. 2, the row electrode driver generates reset pulses $RP_X$ of a positive polarity and reset pulses $RP_Y$ of a negative polarity, respectively, and applies them to the row electrodes $X_1$ to $X_n$ and the row electrodes $Y_1$ to $Y_n$ as shown in FIG. 2, respectively. In accordance with the application of the reset pulses $RP_X$ and $RP_Y$, all of the discharge cells of the PDP 10 are subjected to a reset discharge, and a predetermined amount of wall charges are uniformly formed in each discharge cell.

Subsequently, in an address step Wc, the driving apparatus 100 forms pixel data corresponding to each discharge cell based on the input video signal. The column electrode driver generates pixel data pulses having a pulse voltage corresponding to a logic level of each pixel data. For example, when the pixel data has the logic level "1", the column electrode driver generates the pixel data pulses having a pulse voltage of a high voltage. When the pixel data has the logic level "0", the column electrode driver generates the pixel data pulses having a pulse voltage of a low voltage (0 volt). The column electrode driver sequentially applies pixel data pulse groups $DP_1$, $DP_2$, . . . , $DP_n$ obtained by grouping the pixel data pulses for each display line (m pulses) to the column electrodes $Z_1$ to $Z_m$ as shown in FIG. 2. During this period, the row electrode driver generates scanning pulses SP of a negative polarity as shown in FIG. 2 synchronously with the timing of the application of each pixel data pulse group DP and sequentially applies them to the row electrodes $Y_1$ to $Y_n$. Consequently, a discharge (selective erasure discharge) occurs only in the discharge cell existing in a intersecting portion of the display line to which the scanning pulse SP has been applied and the "column" to which the pixel data pulse of a high voltage has been applied. Wall charges formed in the discharge cell are extinguished.

Subsequently, in a light emission sustaining step Ic, as shown in FIG. 2, the row electrode driver alternately and repetitively generates sustaining pulses $IP_X$ and $IP_Y$ of a positive polarity and applies them to the row electrodes $X_1$ to $X_n$ and the row electrodes $Y_1$ to $Y_n$, respectively. In the light emission sustaining step Ic, the number of sustaining pulses $IP_X$ and $IP_Y$ which are repetitively applied is equal to the number of times corresponding to the discharge light emitting period allocated to each subfield as mentioned above. In accordance with the application of those sustaining pulses IP, only the discharge cell in which the wall charges remain in the discharge space discharges (sustaining discharge) each time the sustaining pulses $IP_X$ and $IP_Y$ are applied. That is, only the discharge cell in which the selective erasure discharge is not caused in the address step Wc repeats the light emission associated by the sustaining discharge for a period of time allocated to each subfield and maintains the light emitting state.

The driving apparatus 100 controls the row electrode driver and column electrode driver so as to execute a series of operations comprising all-resetting step Rc, address step Wc, and light emission sustaining step Ic for each subfield. According to the above-described control scheme, the light emission associated with the sustaining discharge is performed during the display period of one field a number of times corresponding to the luminance level of the input video signal. In this process, visually, an intermediate luminance according to the number of times of the executed light emission is expressed during the display period of one field.

Since the various driving pulses as mentioned above have a relatively high voltage, if the driver for generating the driving pulses operates erroneously and is short-circuited therein, a large current flows into the driver for a long period of time, so that an excessive power loss occurs continuously. To prevent it, an excessive current detecting circuit to detect an excessive current is provided on a common power line for supplying a power voltage to each driver, and a power shut-off circuit to forcedly shut off the power source upon detection of the excessive current is provided. In this instance, since the column electrode driver is actually constructed by m independent drivers corresponding to the column electrodes $Z_1$ to $Z_m$, an amount of current flowing on the common power line also depends on the pixel data. A problem, therefore, such that even if one driver in the column electrode driver is short-circuited therein and a large current flows in the driver and its influence is reflected onto the common power line, whether it is caused by the excessive current or not cannot be easily discriminated occurs. That is, it is because even if each driver functions normally, there is a case where the pixel data pulses of the high voltage are generated simultaneously from many drivers in dependence on the pixel data, and in this instance, a large current flows on the common power line.

OBJECTS AND SUMMARY OF THE INVENTION

The invention has been made to solve the problems mentioned above and it is an object of the invention to provide a plasma display apparatus which can certainly prevent an excessive power loss of a driver for driving electrodes of a plasma display panel.

According to the first aspect of the invention, there is provided a plasma display apparatus which has a plasma display panel that has a plurality of row electrode pairs corresponding to display lines and a plurality of column electrodes arranged so as to cross each of the row electrode pairs and in that a discharge cell functioning as a pixel is formed in each intersecting portion of the row electrode pairs and the column electrodes, and in which for driving the plasma display panel a display period of one field is constituted by a plurality of subfields each comprising an address period of time and a light emission sustaining period of time, comprising: a column electrode driver for generating pixel data pulses corresponding to a video signal during the address period of time and sequentially applying them to the column electrodes for each display line; and a row electrode driver for generating scanning pulses synchronously with a timing of application of each of the pixel data pulses during the address period of time, sequentially applying them to one row electrode of each of the row electrode pairs, and alternately and repetitively applying sustaining pulses to all of the row electrode pairs during the light emission sustaining period of time, wherein the column electrode driver comprises a power supplying circuit for generating a power potential having a predetermined electric potential and applying it to a power line and a data pulse driver for selectively applying the power potential on the power line to each of the column electrodes in accordance with the video signal of each display line thereby forming the pixel data pulses, and the apparatus further has a driver protecting unit for detecting a value of a current on the power line during the light emission sustaining period of time, thereby shutting off the power source of the column electrode driver based on the detected current value.

According to the second aspect of the invention, there is provided a plasma display apparatus which has a plasma display panel that has a plurality of row electrode pairs corresponding to display lines and a plurality of column electrodes arranged so as to cross each of the row electrode pairs and in that a discharge cell functioning as a pixel is formed in each intersecting portion of the row electrode pairs and the column electrodes, and in which for driving the plasma display panel a display period of one field is constituted by a plurality of subfields each comprising an address period and a light emission sustaining period, comprising: a column electrode driver for generating pixel data pulses corresponding to a video signal during the address period of time and sequentially applying them to the column electrodes for each display line; and a row electrode driver for generating scanning pulses synchronously with a timing of application of each of the pixel data pulses during the address period, sequentially applying them to one row electrode of each of the row electrode pairs, and alternately and repetitively applying sustaining pulses to all of the row electrode pairs during the light emission sustaining period of time, wherein the column electrode driver comprises a power supplying circuit for generating a power potential having a predetermined electric potential and applying it to a power line and a data pulse driver for selectively applying the power potential on the power line to each of the column electrodes in accordance with the video signal of each display line thereby forming the pixel data pulses, applying the power potential to each of the column electrodes only for a predetermined period of time at the end of the address period of time, and thereafter, setting all of the column electrodes into a high impedance state, and the apparatus further has a driver protecting unit for detecting an electric potential on the power line during the light emission sustaining period of time, thereby shutting off the power source of the column electrode driver based on the detected electric potential.

DETAILED DESCRIPTION OF THE PREFERRED EMBODIMENT

An embodiment of the invention will be described in detail hereinbelow with reference to the drawings.

Figure 1:
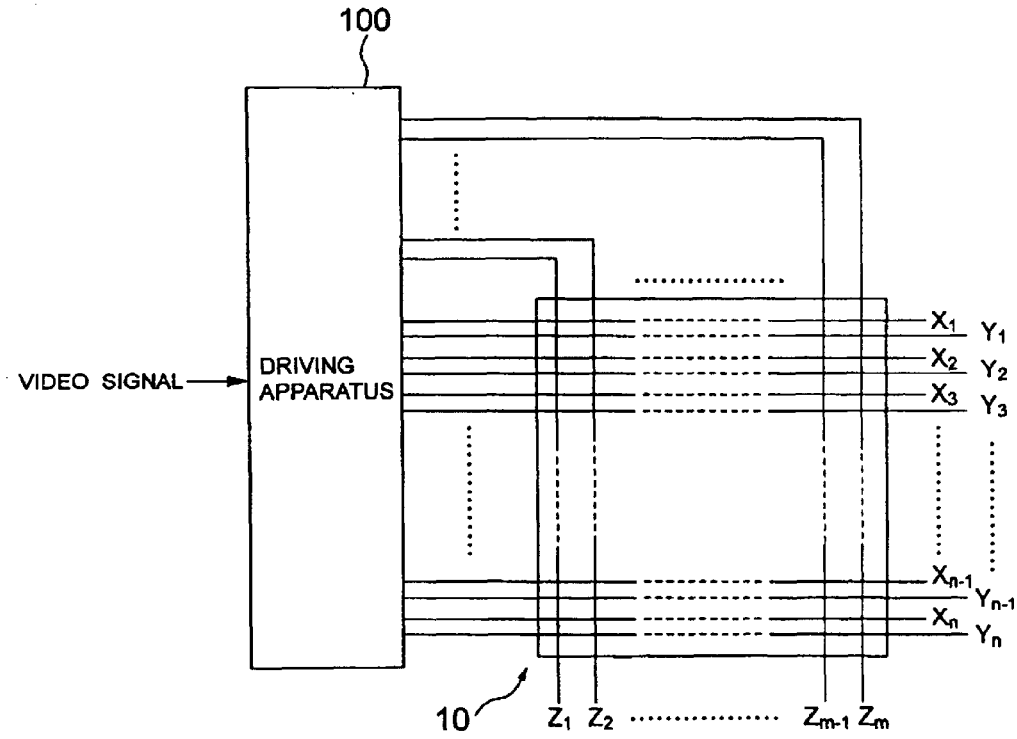
Related Art FIG. 1
FIG. 1 is a diagram showing a schematic construction of a plasma display apparatus.
Figure 2:
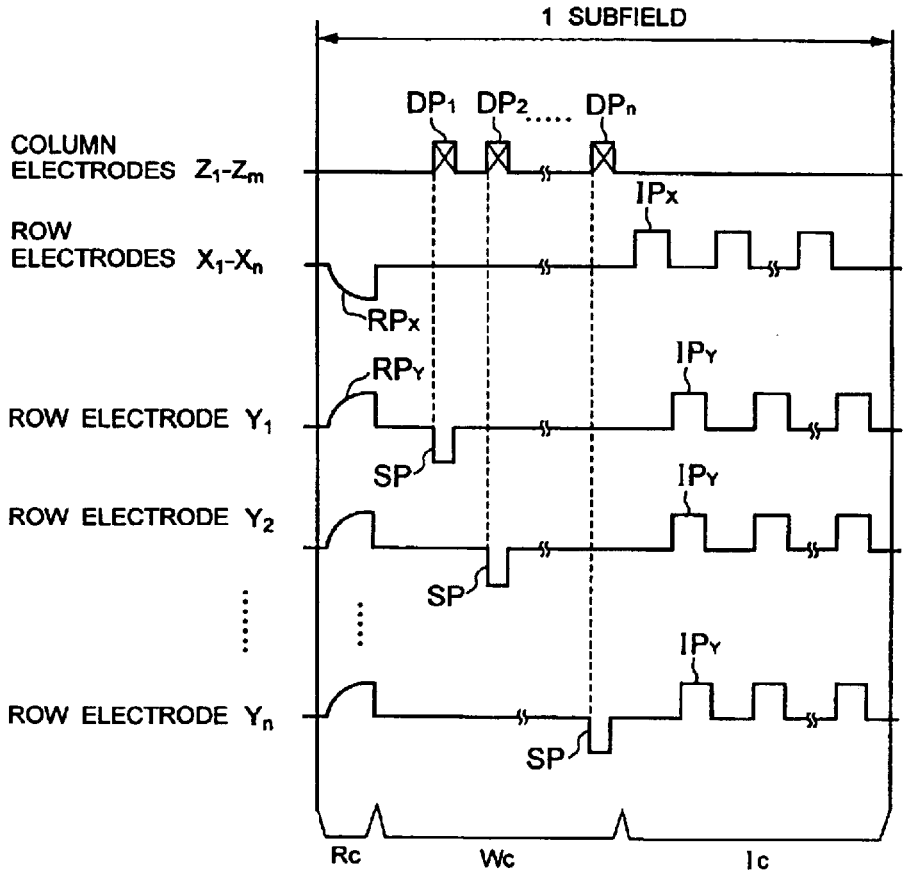
Related Art FIG. 2
FIG. 2 is a diagram showing an example of various driving pulses which are applied to a PDP 10 in one subfield when a driving based on a subfield method is used and their application timings.
Figure 3:
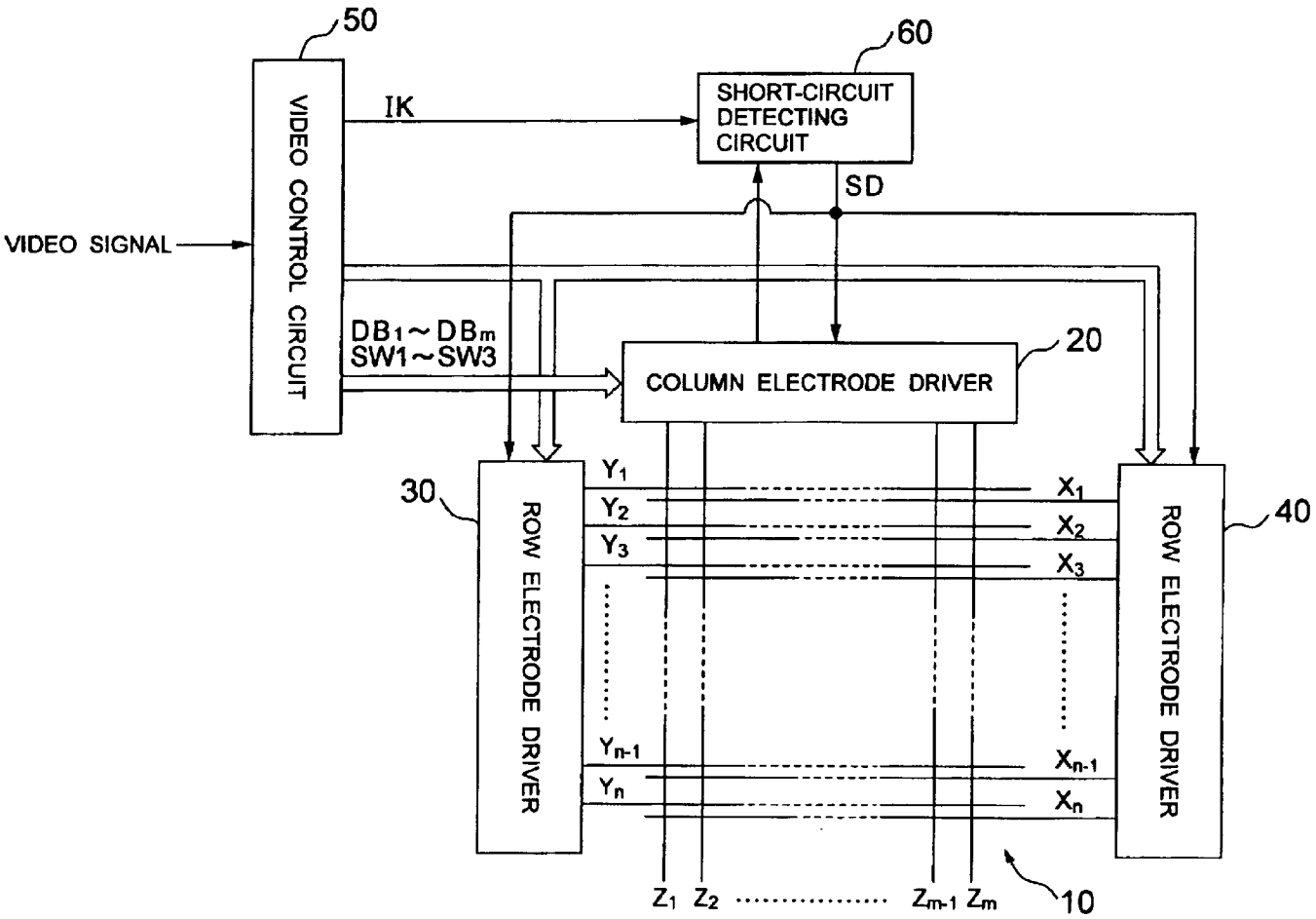
FIG. 3 is a diagram showing a schematic construction of the plasma display apparatus according to the invention.

FIG. 3 is a diagram showing a schematic construction of a plasma display apparatus according to the invention.

In FIG. 3, the PDP 10 as a plasma display panel comprises: the m column electrodes $Z_1$ to $Z_m$; and the n row electrodes $X_1$ to $X_n$ and n row electrodes $Y_1$ to $Y_n$ arranged so as to cross the column electrodes, respectively. The row electrodes $X_1$ to $X_n$ and row electrodes $Y_1$ to $Y_n$ construct the first display line to the nth display line in the PDP 10 by pairs of row electrodes $X_i$ ($1 \leqq i \leqq n$) and $Y_i$ ($1 \leqq i \leqq n$), respectively. A discharge space filled with a discharge gas is formed between the column electrode Z and the row electrodes X and Y. A discharge cell which performs a discharge light emission in red, a discharge cell which performs a discharge light emission in green, or a discharge cell which performs a discharge light emission in blue is formed at each intersecting portion of each row electrode pair and the column electrode including the discharge space.

Figure 4:
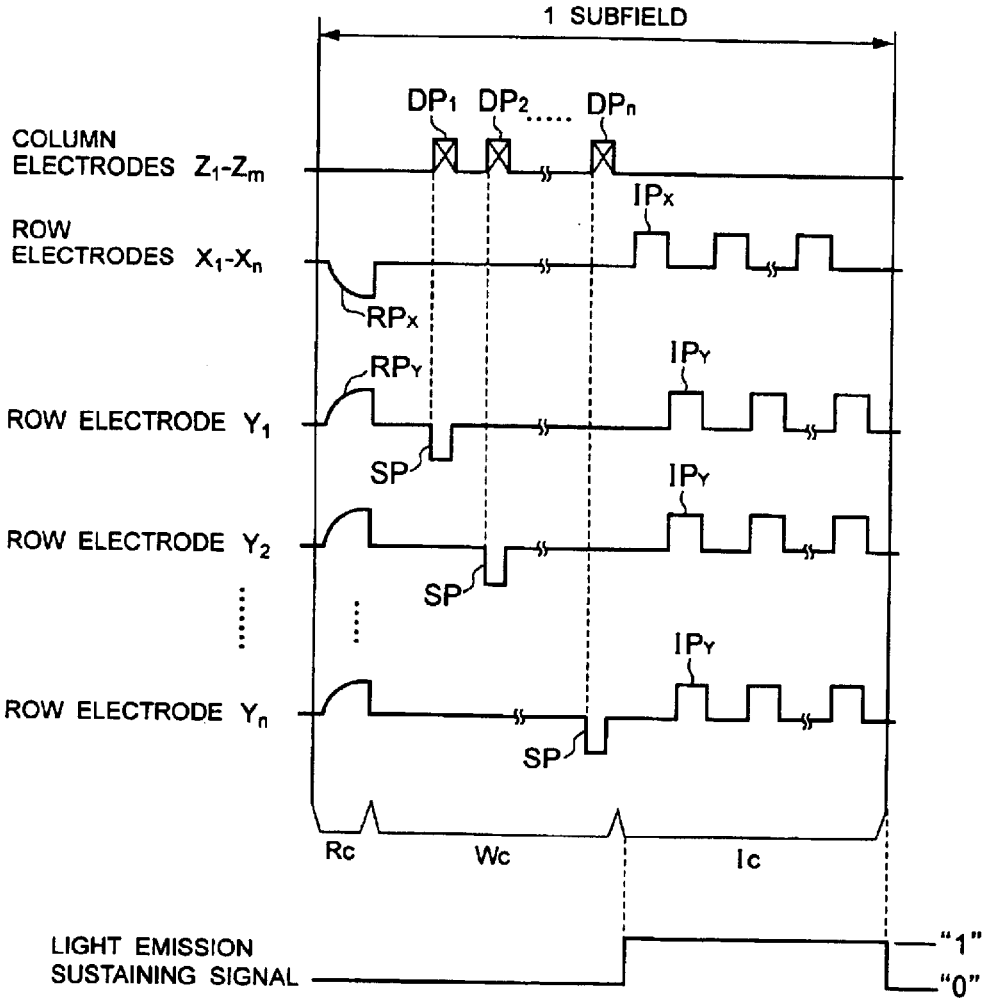
FIG. 4 is a diagram showing an example of various driving pulses which are applied to the PDP 10 of the plasma display apparatus shown in FIG. 3 and their application timings.

A row electrode driver 30 generates the reset pulses $RP_X$ of a negative polarity and the sustaining pulses $IP_X$ of a positive polarity as shown in FIG. 4 in response to a timing signal supplied from a drive control circuit 50 and applies them to the row electrodes $X_1$ to $X_n$ of the PDP 10. A row electrode driver 40 generates the reset pulses $RP_Y$ of a positive polarity, the scanning pulses SP, and the sustaining pulses $IP_Y$ as shown in FIG. 4 in response to a timing signal supplied from the drive control circuit 50 and applies them to the row electrodes $Y_1$ to $Y_n$ of the PDP 10.

A column electrode driver 20 generates the pixel data pulses having the pulse voltage corresponding to the logic level of each of pixel data bits $DB_1$ to $DB_m$ supplied from the drive control circuit 50. The column electrode driver 20 sequentially applies the pixel data pulse groups $DP_1$ to $DP_n$ obtained by grouping the pixel data pulses for each display line (m pulses) to the column electrodes $Z_1$ to $Z_m$ of the PDP 10, respectively.

Figure 5:
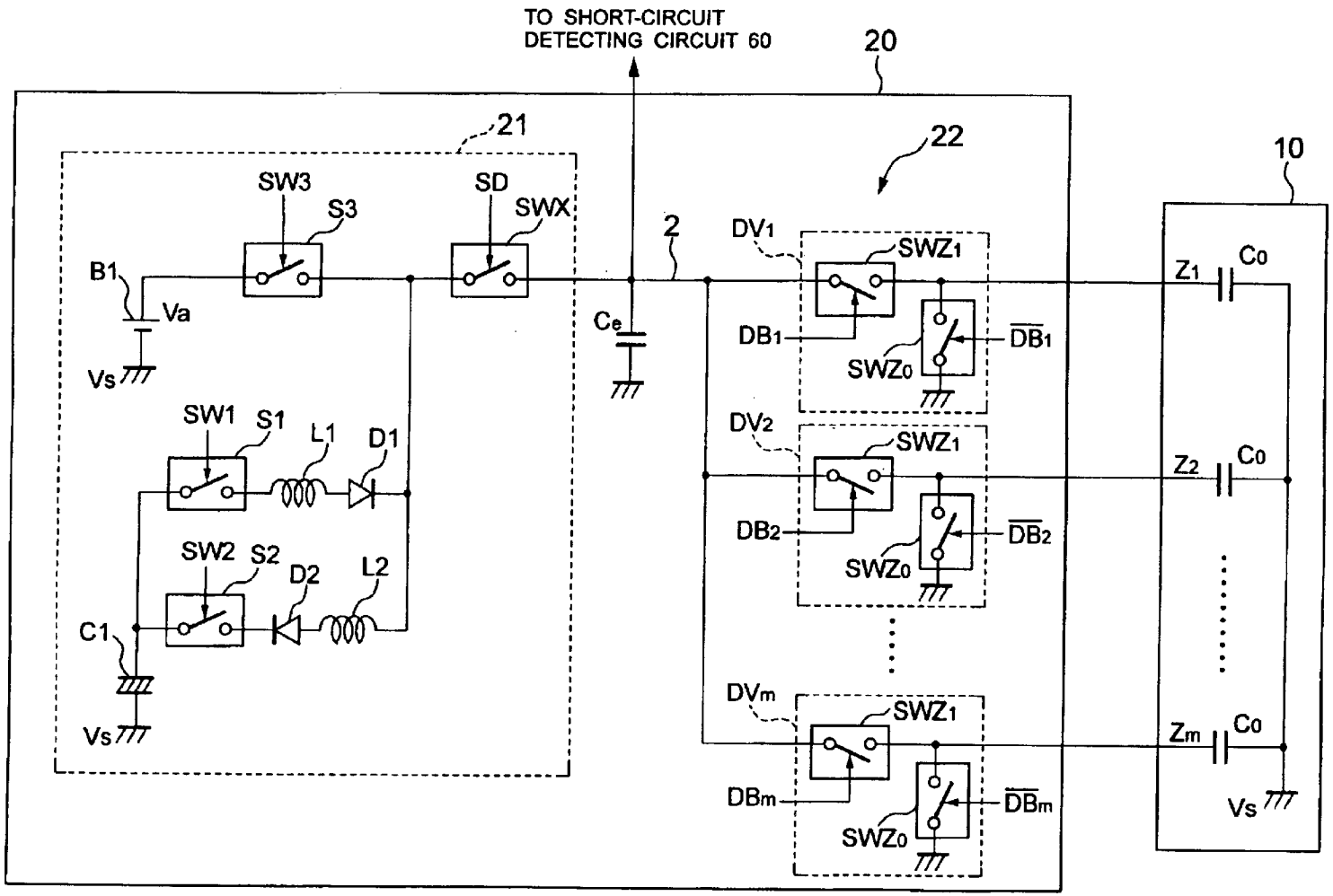
FIG. 5 is a diagram showing an example of an internal construction of a column electrode driver 20.

FIG. 5 is a diagram showing an internal construction of the column electrode driver 20.

As shown in FIG. 5, the column electrode driver 20 is constructed by a power supplying circuit 21 and a pixel data pulse generating circuit 22.

One end of a capacitor C1 in the power supplying circuit 21 is set to a ground potential Vs of the PDP 10. A switching device S1 is OFF while a switching signal SW1 of the logic level "0" is supplied from the drive control circuit 50. When the logic level of the switching signal SW1 is equal to "1", the switching device S1 is turned on, thereby allowing an electric potential caused at the other end of the capacitor C1 to be applied onto a power line 2 via a coil L1, a diode D1, and a power shut-off switch SWX. A switching device S2 is OFF while a switching signal SW2 of the logic level "0" is supplied from the drive control circuit 50. When the logic level of the switching signal SW2 is equal to "1", the switching device S2 is turned on, thereby allowing the electric potential on the power line 2 to be applied to the other end of the capacitor C1 via the power shut-off switch SWX, a coil L2, and a diode D2. In this instance, the capacitor C1 is charged by the electric potential on the power line 2. A switching device S3 is OFF while a switching signal SW3 of the logic level "0" is supplied from the drive control circuit 50. When the logic level of the switching signal SW3 is equal to "1", the switching device S3 is turned on, thereby allowing a power potential Va obtained by a DC power source B1 to be applied onto the power line 2 via the power shut-off switch SWX. A negative side terminal of the DC power source B1 is set to the ground potential Vs. As will be explained hereinlater, the power shut-off switch SWX is always fixed to the ON state in the cases other than the case where a short-circuit detection signal SD of the logic level "1" is supplied from a short-circuit detecting circuit 60.

Figure 6:
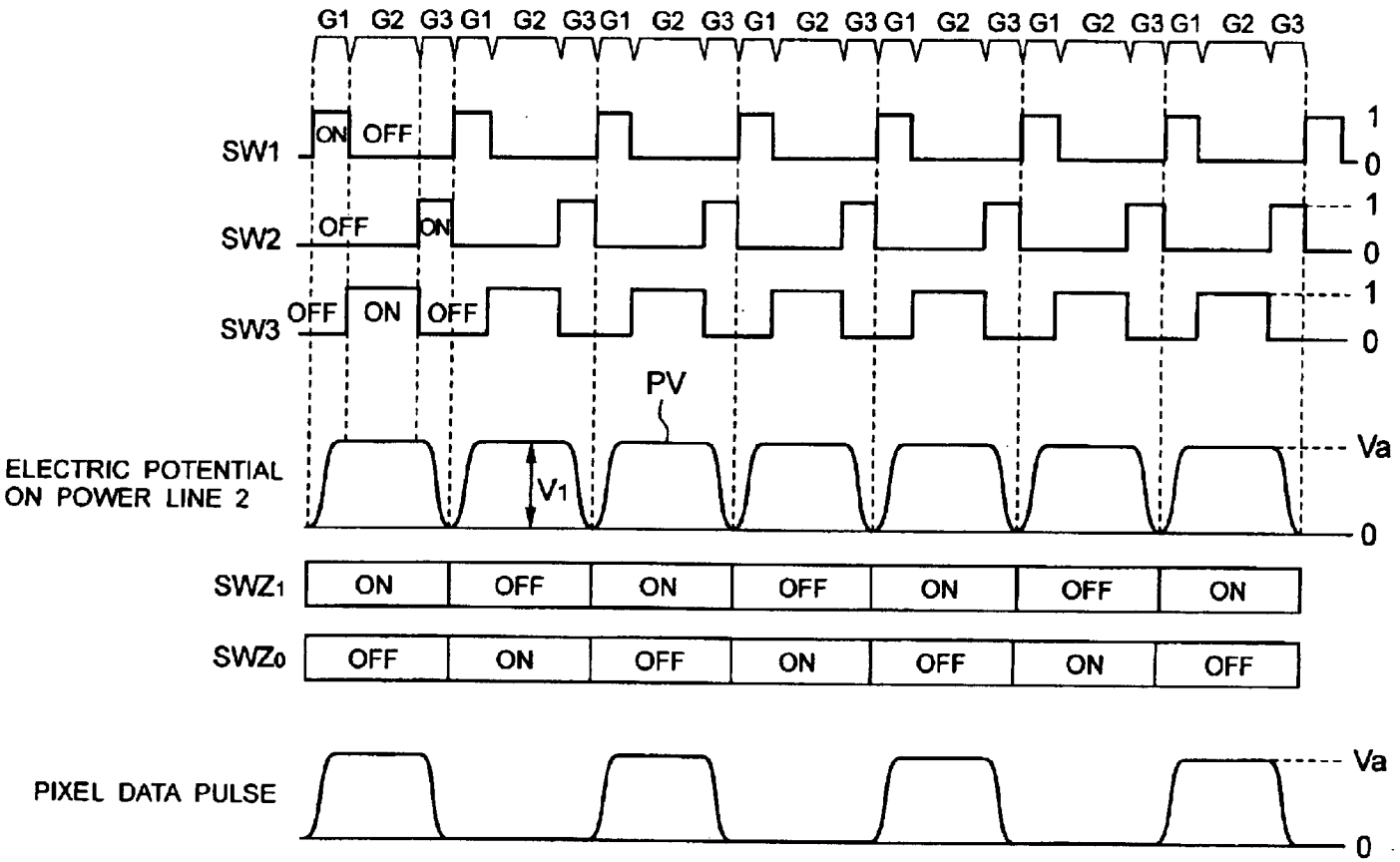
FIG. 6 is a diagram showing an internal operation of a power supplying circuit 21.

The drive control circuit 50 supplies the switching signals SW1 to SW3 which are shifted in accordance with a sequence as shown in FIG. 6 to the switching devices S1 to S3 of the power supplying circuit 21, respectively.

First, in a driving step G1, only the switching device S1 among the switching devices S1 to S3 is turned on and the charges accumulated in the capacitor C1 are discharged. A discharge current associated by the discharge flows into the power line 2 via the switching device S1, the coil L1, the diode D1, and the power shut-off switch SWX. In this instance, the electric potential on the power line 2 gradually rises due to the discharge by the capacitor C1 and a resonance operation by the coil L1 and a load capacitor $C_0$ as shown in FIG. 6.

Subsequently, in a driving step G2, since only the switching device S3 among the switching devices S1 to S3 is turned on, the power potential Va by the DC power source B1 is directly applied onto the power line 2.

Subsequently, in a driving step G3, the switching device S3 is switched to the OFF state and the switching device S2 is switched to the ON state. When the switching device S3 is switched to the OFF state, the application of the power potential Va is stopped. Since the switching device S2 is turned on, the load capacitor $C_0$ of the PDP 10 starts to discharge. By the discharge, the current flows into the capacitor C1 via a column electrode $Z_I$, switching device $SWZ_I$, power line 2, power shut-off switch SWX, coil L2, diode D2, and switching device S2. That is, the charges accumulated in the load capacitor $C_0$ of the PDP 10 are collected into the capacitor C1 of the power supplying circuit 21. At this time, the electric potential on the power line 2 gradually decreases as shown in FIG. 6 due to a time constant which is determined by the coil L2 and load capacitor $C_0$.

By repetitively executing the operation comprising the driving steps G1 to G3, the power supplying circuit 21 generates a resonance pulse power potential PV having a predetermined amplitude $V_1$ as shown in FIG. 6 and applies it onto the power line 2.

The pixel data pulse generating circuit 22 shown in FIG. 5 is constructed by data pulse drivers $DV_1$ to $DV_m$ provided in correspondence to the column electrodes $Z_1$ to $Z_m$ of the PDP 10, respectively. The pixel data bits $DB_1$ to $DB_m$ are supplied from the drive control circuit 50 to the data pulse drivers $DV_1$ to $DV_m$ in correspondence to each other, respectively. Each data pulse driver DV is constructed by: a data switching device $SWZ_1$ for connecting and disconnecting the power line 2 and column electrode Z in accordance with the pixel data bit DB supplied to the data pulse driver DV; and a data switching device $SWZ_0$ for setting the column electrode Z to the ground potential Vs. For example, when the pixel data bit DB is at the logic level "1", the data switching device $SWZ_1$ is turned on and connects the power line 2 and column electrode Z. When the pixel data bit DB is at the logic level "0", the data switching device $SWZ_1$ is turned-off and disconnects the power line 2 and column electrode Z. When the pixel data bit DB is at the logic level "1", the data switching device $SWZ_0$ is turned off and connects the power line 2 and column electrode Z. When the pixel data bit DB is at the logic level "0", the data switching device $SWZ_0$ is turned on and sets the column electrode Z to the ground potential Vs. That is, the data switching devices $SWZ_0$ and $SWZ_1$ are complementarily turned on and off based on the logic level of the pixel data bit DB. While the pixel data bit DB supplied from the drive control circuit 50 is at the logic level "1" in correspondence to the data pulse driver DV, each data pulse driver DV applies the resonance pulse power potential PV as shown in FIG. 6 to the column electrode Z. That is, it becomes the pixel data pulse of a high voltage as mentioned above. When the pixel data bit DB is at the logic level "0", the data pulse driver DV applies the ground potential Vs to the column electrode Z. That is, it becomes the pixel data pulse of a low voltage as mentioned above.

The short-circuit detecting circuit 60 shown in FIG. 3 detects the value of the current flowing on the power line 2 of the column electrode driver 20 in accordance with a light emission sustaining signal IK supplied from the drive control circuit 50. Based on the detected current value, the short-circuit detecting circuit 60 detects whether an internal short-circuit has occurred in at least one of the data pulse drivers $DV_1$ to $DV_m$ or not. That is, the short-circuit detecting circuit 60 detects whether the data switching devices $SWZ_1$ and $SWZ_0$ formed in the data pulse driver DV are simultaneously ON or not (short-circuited or not). The short-circuit detecting circuit 60 supplies the short-circuit detection signal SD indicative of a result of the detection to the row electrode drivers 30 and 40 and the power shut-off switch SWX of the column electrode driver 20, respectively.

The drive control circuit 50 controls the column electrode driver 20 and the row electrode drivers 30 and 40 so as to gradation drive the PDP 10 by using the subfield method as mentioned above, respectively. That is, the drive control circuit 50 divides one field display period of time into a plurality of subfields and controls each of the various drivers so as to execute the driving as shown in FIG. 4 for each subfield. By the control, each of the column electrode driver 20 and the row electrode drivers 30 and 40 generates the various driving pulses at timings, which will be explained hereinbelow, and drives the PDP 10.

First, in the all-resetting step Rc shown in FIG. 4, the row electrode driver 30 generates the reset pulses $RP_X$ of the negative polarity and applies them to the row electrodes $X_1$ to $X_n$ in a lump, respectively. Simultaneously with the reset pulses $RP_X$, the row electrode driver 40 generates the reset pulses $RP_Y$ of the positive polarity as shown in FIG. 4 and applies them to the row electrodes $Y_1$ to $Y_n$ in a lump, respectively. In accordance with the application of the reset pulses $RP_X$ and $RP_Y$, all of the discharge cells of the PDP 10 are reset discharged, and a predetermined amount of wall charges are uniformly formed in each discharge cell. During the execution of the all-resetting step Rc, the drive control circuit 50 supplies the light emission sustaining signal IK of the logic level "0" as shown in FIG. 4 to the short-circuit detecting circuit 60.

Subsequently, in the address step Wc shown in FIG. 4, the drive control circuit 50 converts the supplied video signal into pixel data of, for example, eight bits for each pixel and obtains the pixel data bit DB in which the pixel data has been divided for each bit digit. The drive control circuit 50 extracts the pixel data bits $DB_1$ to $DB_m$ corresponding to the first to mth columns belonging to the row for each row with respect to the same bit digit and supplies them to the column electrode driver 20. In this instance, the column electrode driver 20 generates the pixel data pulses having the pulse voltage corresponding to the logic levels of the pixel data bits $DB_1$ to $DB_m$. For example, when the pixel data is at the logic level "1", the column electrode driver 20 generates the pixel data pulses having the pulse voltage of a high voltage. When the pixel data is at the logic level "0", the column electrode driver 20 generates the pixel data pulses having the pulse voltage of a low voltage (0 volt). The column electrode driver 20 sequentially applies the pixel data pulse groups $DP_1$, $DP_2$, . . . , $DP_n$ obtained by grouping the pixel data pulses for each display line (m pulses) to the column electrodes $Z_1$ to $Z_m$ as shown in FIG. 4, respectively. Further, in the address step Wc, the row electrode driver 40 generates the scanning pulses SP of the negative polarity as shown in FIG. 4 synchronously with the timing of application of each pixel data pulse group DP and sequentially applies them to the row electrodes $Y_1$ to $Y_n$. In this process, a discharge (selective erasure discharge) occurs only in the discharge cell existing in the intersecting portion of the display line to which the scanning pulse SP has been applied and the column electrode to which the pixel data pulse of the high voltage has been applied. Wall charges formed in the discharge cell are extinguished.

During the execution of the address step Wc, the drive control circuit 50 supplies the light emission sustaining signal IK of the logic level "0" as shown in FIG. 4 to the short-circuit detecting circuit 60.

Subsequently, in the light emission sustaining step Ic shown in FIG. 4, the row electrode drivers 30 and 40 alternately and repetitively generates the sustaining pulses $IP_X$ and $IP_Y$ of the positive polarity and applies them to the row electrodes $X_1$ to $X_n$ and the row electrodes $Y_1$ to $Y_n$ as shown in FIG. 4, respectively. In the light emission sustaining step Ic, the number of sustaining pulses $IP_X$ and $IP_Y$ which are repetitively applied is equal to the number of times corresponding to the discharge light emitting period allocated to each subfield as mentioned above. In accordance with the application of those sustaining pulses IP, only the discharge cell in which the wall charges remain in the discharge space discharges (sustaining discharge) each time the sustaining pulses $IP_X$ and $IP_Y$ are applied. That is, only the discharge cell in which the selective erasure discharge is not caused in the address step Wc repeats the light emission associated by the sustaining discharge during the period of time allocated to each subfield, and maintains the light emitting state.

The drive control circuit 50 controls the column electrode driver 20 and the row electrode drivers 30 and 40 so as to execute the operation in the all-resetting step Rc, address step Wc, and light emission sustaining step Ic for each subfield.

During the execution of the light emission sustaining step Ic, the drive control circuit 50 supplies the light emission sustaining signal IK of the logic level "1" as shown in FIG. 4 to the short-circuit detecting circuit 60. Only while the light emission sustaining signal IK of the logic level "1" is supplied, the short-circuit detecting circuit 60 discriminates whether the current flowing onto the power line 2 in the column electrode driver 20 is larger than a predetermined current or not. In this instance, if it is decided that the current is smaller than the predetermined current, the short-circuit detecting circuit 60 determines that no internal short-circuit occurs in each data pulse driver DV of the column electrode driver 20 or not, and generates the short-circuit detection signal SD of the logic level "0". If it is decided that the current on the power line 2 is larger than the predetermined current, the short-circuit detecting circuit 60 determined that one of the data switching devices SWZ in each data pulse driver DV has been short-circuited, and generates the short-circuit detection signal SD of the logic level "1". In response to the short-circuit detection signal SD of the logic level "1", the power supplying circuit (not shown) provided in each of the row electrode drivers 30 and 40 is forcedly turned off. While the short-circuit detection signal SD is at the logic level "0", the power shut-off switch SWX of the column electrode driver 20 relays the resonance pulse power potential PV generated by the power supplying circuit 21 onto the power line 2. While the short-circuit detection signal SD is at the logic level "1", the power shut-off switch SWX stops the supply of the resonance pulse power potential PV to the power line 2.

Figure 7:
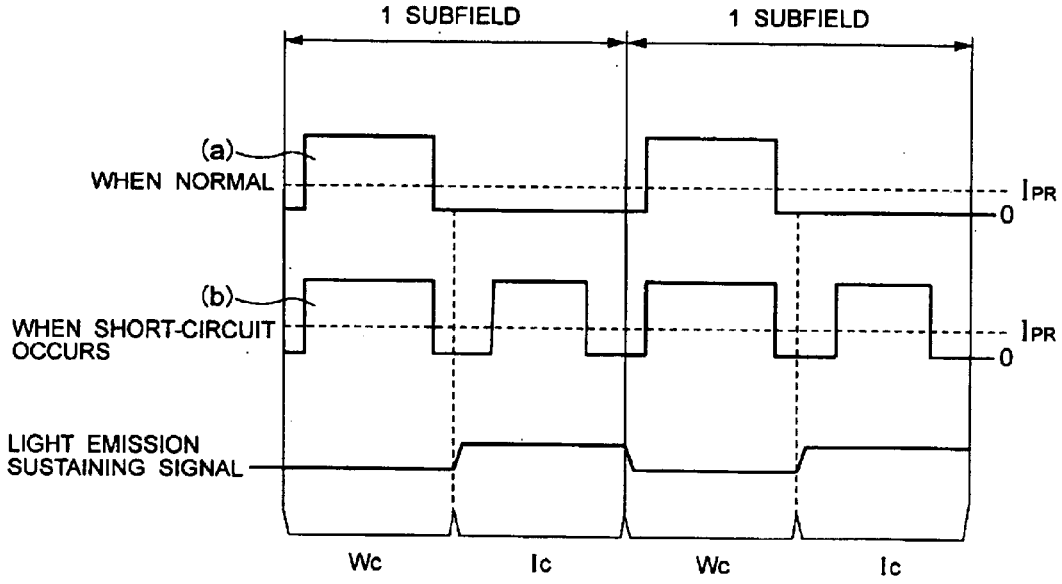
FIG. 7 is a diagram showing a transition of a value of a current flowing on a power line 2 of the power supplying circuit 21.

That is, when the data switching devices $SWZ_1$ and $SWZ_0$ formed in each data pulse driver DV of the column electrode driver 20 is operating normally (non-short-circuit state), the current flowing on the power line 2 is shifted as shown in a waveform (a) in FIG. 7. That is, as shown in the waveform (a) in FIG. 7, although the current larger than a predetermined current $I_{PR}$ flows onto the power line 2 upon execution of the address step Wc, the current value is shifted to "0" upon execution of the light emission sustaining step Ic. If the internal short-circuit occurred in at least one of the data pulse drivers $DV_1$ to $DV_m$, even upon execution of the light emission sustaining step Ic, the current flowing on the power line 2 is larger than the predetermined current $I_{PR}$. That is, if the internal short-circuit occurs in the data pulse driver DV (the data switching devices $SWZ_1$ and $SWZ_0$ are simultaneously turned on), the current based on the resonance pulse power potential PV generated by the power supplying circuit 21 flows into the path comprising the power line 2 and the data switching devices $SWZ_1$ and $SWZ_0$. The value of the current on the power line 2, thus, exceeds the predetermined current $I_{PR}$. In this instance, since a withstanding voltage of the data switching device $SWZ_0$ is lower than that of $SWZ_1$, if a large current exceeding the predetermined current $I_{PR}$ flows for a long time, an excessive power loss occurs.

In the short-circuit detecting circuit 60, therefore, by discriminating whether the current on the power line 2 is larger than the predetermined current $I_{PR}$ or not only during the period of time of the execution of the light emission sustaining step Ic as shown in FIG. 7, whether the internal short-circuit has occurred in at least one of the data pulse drivers DV or not is detected. If the internal short-circuit state is detected, the supply of the resonance pulse power potential PV generated by the power supplying circuit 21 to the data pulse driver DV is forcedly stopped by the power shut-off switch SWX.

Owing to the driver protecting device comprising the short-circuit detecting circuit 60 and the power shut-off switch SWX, therefore, even if the internal short-circuit has occurred in only one of the data pulse drivers $DV_1$ to $DV_m$, it is certainly detected and the power source can be shut off. By the use of the driver protecting device, consequently, the column electrode driver 20 can be certainly protected from the overcurrent associated by the internal short-circuit.

Although the above-described short-circuit detecting circuit 60 detects the internal short-circuit of the data pulse driver based on the value of the current on the power line 2, occurence of the internal short-circuit can be also judged by detecting a change in electric potential on the power line 2.

Figure 8:
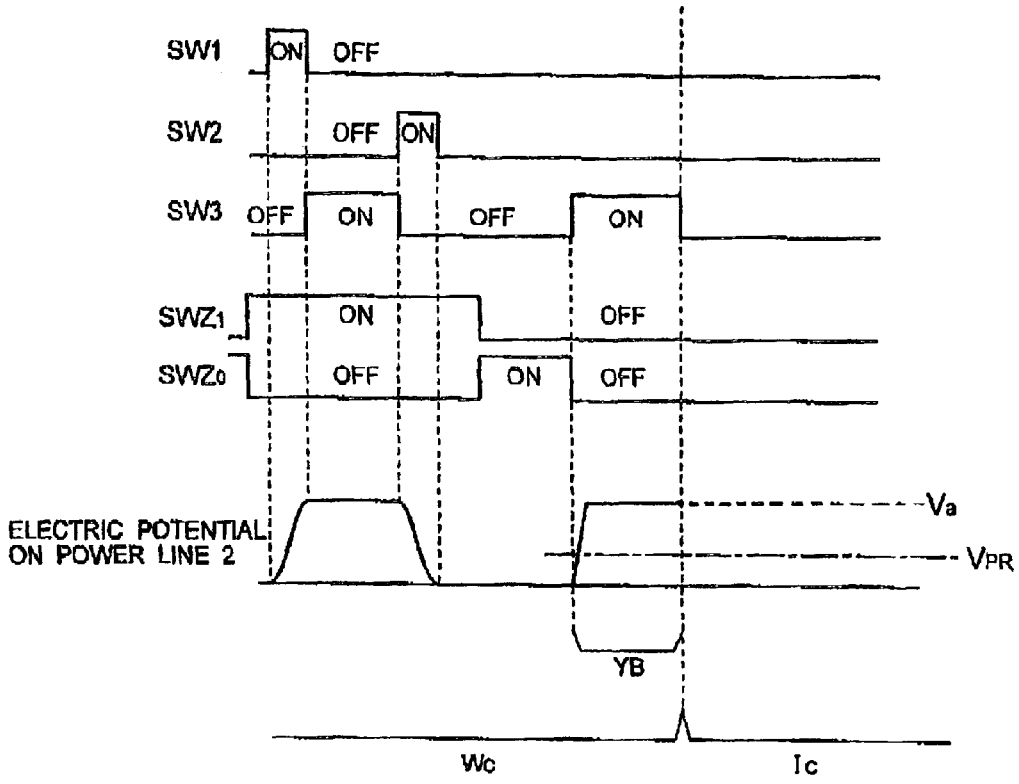
FIG. 8 is a diagram showing the driving operation of the power supplying circuit 21 which is executed when an internal short-circuit is detected based on a change in electric potential on the power line 2.

In this process, the drive control circuit 50 shifts the logic level of the switching signal SW3 from "0" to "1" as shown in FIG. 8 at the end of the address step Wc, that is, after the pixel data pulse group $DP_n$ were applied, and sets the switching device S3 of the power supplying circuit 21 into the ON state (short-circuit detection prestep YB). The power potential Va by the DC power source B1 is, therefore, applied onto the power line 2. Further, in the short-circuit detection prestep YB, the drive control circuit 50 sets both of the data switching devices $SWZ_0$ and $SWZ_1$ of each of all of the data pulse drivers $DV_1$ to $DV_m$ into the OFF state. After execution of the short-circuit detection prestep YB, the drive control circuit 50 shifts the logic level of the switching signal SW3 from "1" to "0" and switches the switching device S3 to the OFF state. As shown in FIG. 8, thus, all of the switching devices S1 to S3 are turned off. In this instance, if the data switching devices $SWZ_0$ and $SWZ_1$ are not short-circuited, the power line 2 enters a high impedance state. The electric potential on the power line 2 is maintained at the power potential Va applied onto the power line 2 at the stage of the short-circuit detection prestep YB as shown in FIG. 8. When both of the data switching devices $SWZ_0$ and $SWZ_1$ are short-circuited, that is, if $SWZ_0$ and $SWZ_1$ are short-circuited in spite of the fact that both of them have been set to the OFF state in the short-circuit detection prestep YB, the electric potential on the power line 2 is equal to 0. The short-circuit detecting circuit 60, therefore, discriminates whether the electric potential on the power line 2 is larger than a predetermined potential $V_{PR}$ as shown in FIG. 8 or not during the execution of the light emission sustaining step Ic after completion of the execution of the short-circuit detection prestep YB. At this time, if it is determined that the electric potential on the power line 2 is larger than the predetermined potential $V_{PR}$, the short-circuit detecting circuit 60 supplies the short-circuit detection signal SD of the logic level "0" showing that no internal short-circuit occurs in all of the data pulse drivers to the column electrode driver 20 and the row electrode drivers 30 and 40. If it is determined that the electric potential is smaller than the predetermined potential $V_{PR}$, the short-circuit detecting circuit 60 generates and supplies the short-circuit detection signal SD of the logic level "1" showing that the internal short-circuit has occurred in at least one of the data pulse drivers to the column electrode driver 20 and the row electrode drivers 30 and 40.

In the embodiment, although the resonance power source using the capacitor C1 and coils L1 and L2 as shown in FIG. 5 has been used as a power supplying circuit 21, the invention is not limited to it, but a simple DC power source or a pump-up power source can be also used.

Figure 9:
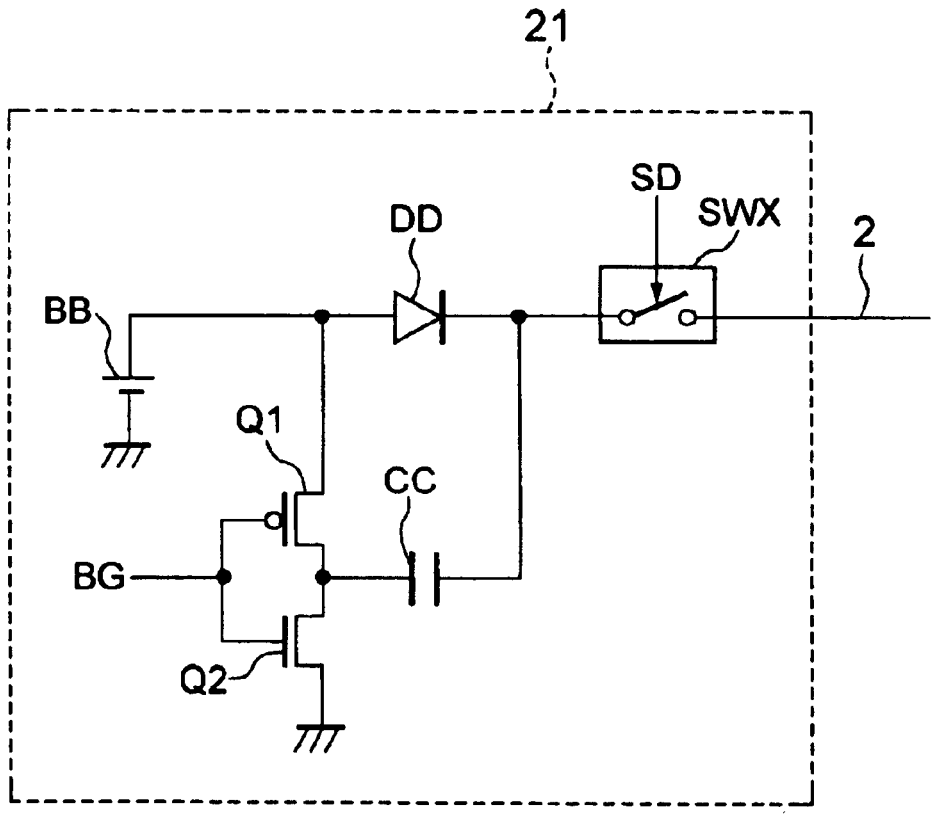
FIG. 9 is a diagram showing another construction of the power supplying circuit 21.

FIG. 9 is a diagram showing another internal construction of the power supplying circuit 21 in the case of using the pump-up power source.

As shown in FIG. 9, in the case where the pump-up power source is used, the power supplying circuit 21 is constitued by: a DC voltage source BB; a diode DD; a capacitor CC; a p-channel FET (field effect transistor) Q1; an n-channel FET Q2; and the power shut-off switch SWX. The operation of the power shut-off switch SWX is the same as that shown in FIG. 5 and the switch SWX is fixed to the ON state except for a case where the short-circuit state is detected as mentioned above.

The DC voltage source BB generates an electric potential (½) $V_1$ as an electric potential of almost ½ of a pulse voltage value $V_1$ of the pixel data pulse and applies it to an anode terminal of the diode DD and a source terminal of the FET Q1. A drain terminal of the FET Q2 and one end of the capacitor CC are connected to a drain terminal of the FET Q1. A source terminal of the FET Q2 is set to the ground potential. The other end of the capacitor CC and a cathode terminal of the diode DD are mutually connected and their connecting point is connected to the power line 2 via the power shut-off switch SWX. A power driving signal BG from the drive control circuit 50 is supplied to a gate terminal of each of the FETs Q1 and Q2. In this state, although the FET Q1 is turned off while the power driving signal BG is at the logic level "1", it is turned on while the power driving signal BG is at the logic level "0", and the FET Q1 supplies the electric potential (½) $V_1$ generated by the DC voltage source BB to one end of the capacitor CC. Although the FET Q2 is turned off while the power driving signal BG is at the logic level "0", it is turned on while the power driving signal BG is at the logic level "1", and the FET Q2 supplies the ground potential to one end of the capacitor CC.

Figure 10:
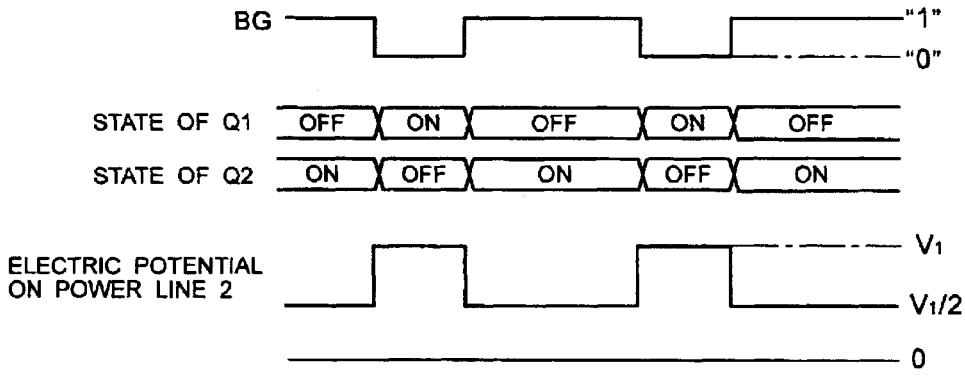
FIG. 10 is a diagram showing the internal operation of the power supplying circuit 21 shown in FIG. 9.

To drive the pump-up power source as shown in FIG. 9, the drive control circuit 50 generates the power driving signal BG having a level transition as shown in FIG. 10.

First, since the FET Q1 is OFF and the FET Q2 is ON while the power driving signal BG is at the logic level "1", the electric potential (½) $V_1$ generated by the DC voltage source BB is applied to the capacitor CC via the diode DD and the power line 2, so that the capacitor CC is charged. At this time, the electric potential on the power line 2 is equal to (½) $V_1$ as shown in FIG. 10. When the power driving signal BG is shifted from the logic level "1" to "0", the FET Q1 is switched to the ON state and the FET Q2 is switched to the OFF state. The electric potential on the power line 2 is, therefore, equal to the electric potential $V_1$ obtained by adding the electric potential (½) $V_1$ supplied by the DC voltage source BB via the diode DD and the electric potential (½) $V_1$ at the other end of the capacitor CC. By repetitively executing the operation as mentioned above, the pulse power potential which is shifted in a range between the electric potential $V_1$ and the electric potential (½) $V_1$ as shown in FIG. 10 is formed onto the power line 2.

In the embodiment, when the internal short-circuit is detected in the data pulse driver, the power source in each of the column electrode driver 20 and the row electrode drivers 30 and 40 is shut off. However, the power source of the plasma display apparatus itself can be also forcibly shut off.

As described in detail above, according to the invention, the current or electric potential on the power line is detected only during the light emission sustaining, period of time, the short-circuit state in the column electrode driver is detected based on the detected current or electric potential, and the power source is shut off.

According to the above construction, even if the internal short-circuit occurred only in one data pulse driver formed in the column electrode driver, it can be easily detected, so that the excessive power loss of the driver can be certainly prevented.

This application is based on Japanese Patent Application No. 2001-163835 which is herein incorporated by reference.

What is claimed is:

1. A plasma display apparatus which has a plasma display panel that has a plurality of row electrode pairs corresponding to display lines and a plurality of column electrodes arranged so as to cross each of said row electrode pairs and in that a discharge cell functioning as a pixel is formed in each intersecting portion of said row electrode pairs and said column electrodes, and in which a display period of one field is constituted by a plurality of subfields each comprising an address period of time and a light emission sustaining period and said plasma display panel is driven, comprising:

a column electrode driver for generating pixel data pulses corresponding to a video signal during said address period and sequentially applying them to said column electrodes for each display line; and a row electrode driver for generating scanning pulses synchronously with a timing of application of each of said pixel data pulses during said address period, sequentially applying them to one row electrode of each of said row electrode pairs, and alternately and repetitively applying sustaining pulses to all of said row electrode pairs during said light emission sustaining period, wherein said column electrode driver comprises a power supplying circuit for generating a power potential having a predetermined electric potential and applying it to a power line and a data pulse driver for selectively applying said power potential on said power line to each of said column electrodes in accordance with said video signal of each display line to thereby form said pixel data pulses, and said apparatus further has a driver protecting part for detecting a value of a current on said power line during said light emission sustaining period, thereby shutting off the power source of said column electrode driver based on said detected current value.

2. An apparatus according to claim 1, wherein said driver protecting part comprises:

a power shut-off switch for connecting or disconnecting said power supplying circuit and said power line; and a short-circuit detecting circuit for, when the value of the current on said power line detected during said light emission sustaining period is larger than a predetermined value, determining that an internal short-circuit has occurred in said data pulse driver, and controlling said power shut-off switch so as to disconnect said power supplying circuit and said power line.

3. An apparatus according to claim 1, wherein said power potential is applied to each of said column electrodes and all of said column electrodes are set to a high impedance state for a predetermined period of time at the end of said address period, and thereafter, the high impedance state is maintained.

4. A plasma display apparatus which has a plasma display panel having a plurality of row electrode pairs corresponding to display lines and a plurality of column electrodes arranged so as to cross each of said row electrode pairs and in that a discharge cell serving as a pixel is formed in each intersecting portion of said row electrode pairs and said column electrodes, and in which a display period of one field is constituted by a plurality of subfields each comprising an address period and a light emission sustaining period and said plasma display panel is driven, comprising:

a column electrode driver for generating pixel data pulses corresponding to a video signal during said address period and sequentially applying them to said column electrodes for each display line; and a row electrode driver for generating scanning pulses synchronously with a timing application of each of said pixel data pulses during said address period of time, sequentially applying them to one row electrode of each of said row electrode pairs, and alternately and repetitively applying sustaining pulses to all of said row electrode pairs during said light emission sustaining period, wherein said column electrode driver comprises a power supplying circuit for generating a power potential having a predetermined electric potential and applying it to a power line and a data pulse driver for selectively applying said power potential on said power line to each of said column electrodes in accordance with said video signal of each display line thereby forming said pixel data pulses, said data pulse driver applying said power potential to each of said column electrodes and setting all or said column electrodes 10 a high impedance state for a predetermined period of time at the end of said address period, and thereafter, maintaining the high impedance state, and said apparatus further has a driver protecting part for detecting an electric potential on said power line during said light emission sustaining period, thereby shutting off the power source of said column electrode driver based on said detected electric potential.

5. An apparatus according to claim 4, wherein said driver protecting part comprises:

a power shut-off switch for connecting or disconnecting said power supplying circuit and said power line; and a short-circuit detecting circuit for determining, when the electric potential on said power line detected during said light emission sustaining period is larger than a predetermined value, that an internal short-circuit has occurred in said data pulse driver, and controlling said power shut-off switch so as to disconnect said power supplying circuit and said power line.

* * * * *